United States Patent [19]

Barlow et al.

[11] Patent Number: 4,674,585

[45] Date of Patent: Jun. 23, 1987

[54] ARTICULATED UNIT VEHICLE

[75] Inventors: Gordon A. Barlow; John R. Krutsch, both of Glenview, Ill.

[73] Assignee: Gordon Barlow Design, Skokie, Ill.

[21] Appl. No.: 813,867

[22] Filed: Dec. 27, 1985

[51] Int. Cl.[4] ..... A63H 17/00

[52] U.S. Cl. ..... 180/14.1; 280/5.2; 446/431; 446/462

[58] Field of Search ..... 180/14.1, 8.1, 8.2, 180/7.1, 9.3, 9.32; 280/5.2, 5.28, 5.32; 305/21, 47, 48; 446/431, 433, 457, 462, 463

[56] References Cited

U.S. PATENT DOCUMENTS

| | | | |
|---|---|---|---|
| 3,049,364 | 8/1962 | Clay | 280/5.28 X |
| 3,288,234 | 11/1966 | Feliz | 180/9.3 X |
| 3,417,832 | 12/1968 | Ziccardi | 180/9.32 X |
| 3,540,151 | 11/1970 | Ishida | 446/462 X |
| 3,591,195 | 7/1971 | Ilon | 280/5.28 X |
| 4,116,497 | 9/1978 | Schimpf et al. | 305/47 X |

FOREIGN PATENT DOCUMENTS

| | | | |
|---|---|---|---|
| 252815 | 2/1912 | Fed. Rep. of Germany | 180/9.32 |
| 2741323 | 9/1978 | Fed. Rep. of Germany | 180/9.3 |

*Primary Examiner*—John J. Love
*Assistant Examiner*—Charles R. Watts
*Attorney, Agent, or Firm*—Kinzer, Plyer, Dorn & McEachran

[57] ABSTRACT

An elongated vehicle adapted to be propelled along an engaging surface and capable of climbing over obstacles on the engaging surface. The vehicle has a plurality of wheeled units including front and rear units with each unit having two axles and wheels mounted on the ends of the axles. Each unit, except for the front and rear units, shares its two axles with adjacent units. The front and rear units each share only one axle with an adjacent unit. Each unit has a body mounted on the axles and the body is rotatable relative to each of the axles. Each body includes side members to maintain the axles spaced apart longitudinally. The side members of the bodies of adjacent units intermesh and overlap at their shared axles to allow adjacent units to rotate vertically relative to each other. The side members include stop surfaces to limit rotation of adjacent units relative to one another about their shared axles. A drive mechanism is provided to drive the wheels.

6 Claims, 11 Drawing Figures

Fig. 7.
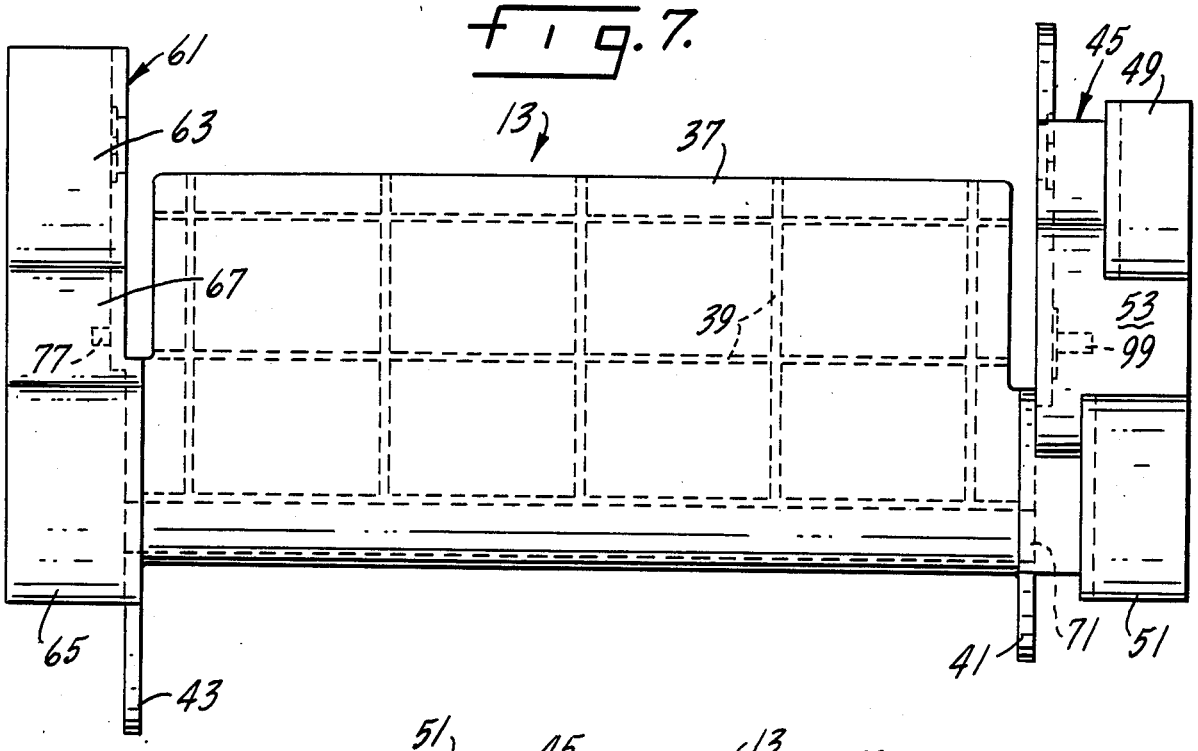
Fig. 8.
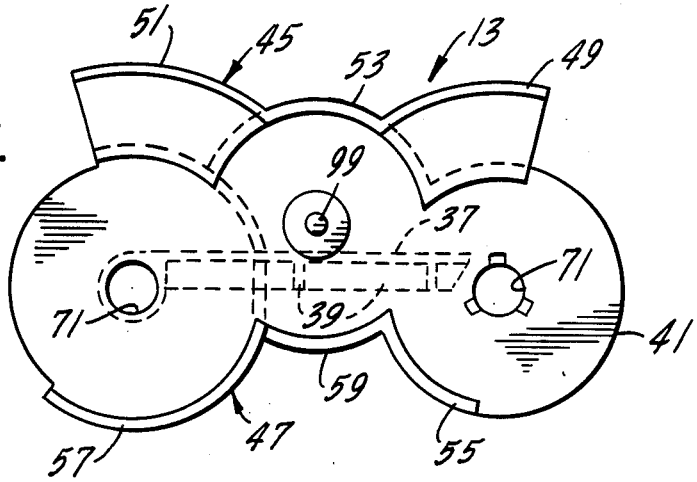
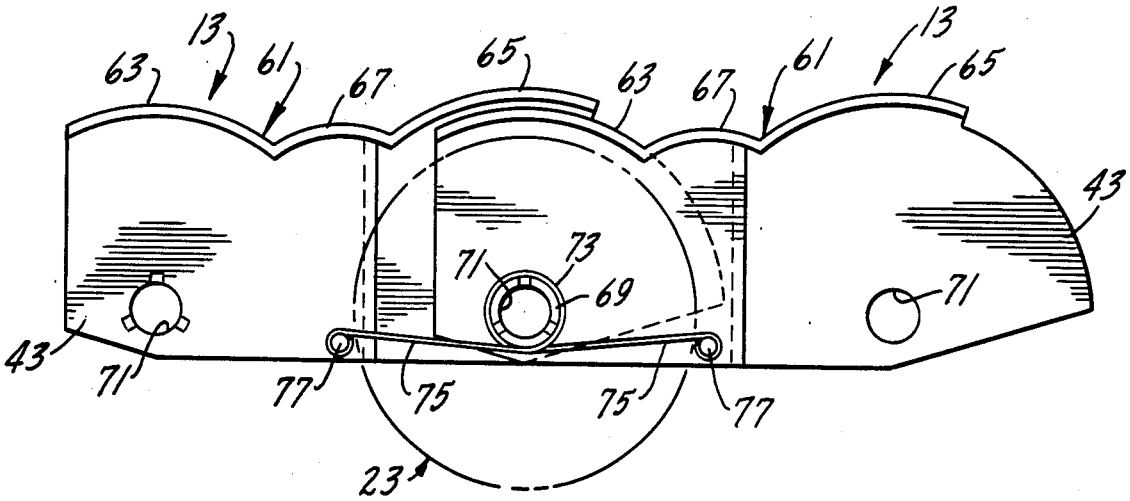
Fig. 9.

ARTICULATED UNIT VEHICLE

BACKGROUND AND SUMMARY OF THE INVENTION

This invention is concerned with a wheeled self-propelled vehicle which can climb over and down obstacles of substantial height in relation to the length of the vehicle without losing its traction or momentum.

An object of this invention is a self-propelled vehicle assembled from individual units which are articulatedly connected to one another to allow the vehicle to be constructed in almost any desired length.

Another object of this invention is an articulated wheeled vehicle having individual wheeled units in which all of the wheels are positively driven by a single power source.

Another object of this invention is a multi-unit wheeled vehicle having individual wheeled units which share axles with adjacent units for flexibility of vertical bending to one another.

Another object of this invention is a multi-unit wheeled vehicle in which the individual units intermesh with one another for flexibility within a limited range of vertical movement and rigidity beyond that range so that the vehicle will push itself up, over and down obstacles.

Another object of this invention is a multi-unit vehicle which can be constructed in almost any desirable length with the length of the vehicle determining the height of an obstruction over which the vehicle can climb.

Other objects may be found in the following specification, claims and drawings.

BRIEF DESCRIPTION OF THE DRAWINGS

The invention is illustrated more or less diagrammatically in the following drawings wherein:

FIG. 7 is a top plan view on an enlarged scale of a detail of a typical unit of the vehicle;

FIG. 8 is a side elevational view of the unit of FIG. 7 as viewed from the right with the background omitted for clarity of illustration;

FIG. 9 is a side elevational view of a pair of interconnected units of the type shown in FIG. 7 with some parts omitted for clarity of illustration;

DESCRIPTION OF THE PREFERRED EMBODIMENT

Figure 1:
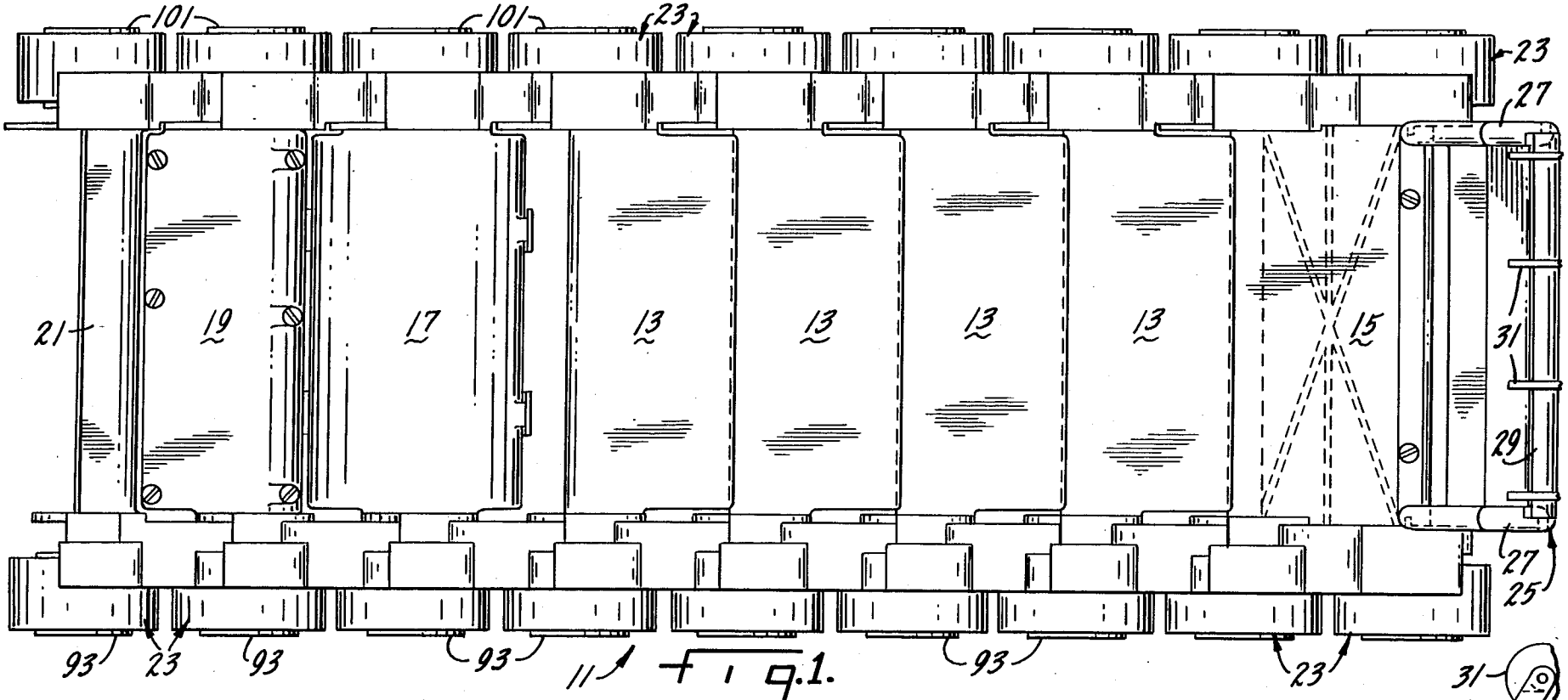
FIG. 1 is a top plan view of a vehicle of this invention supported on a generally level surface.
Figure 4:
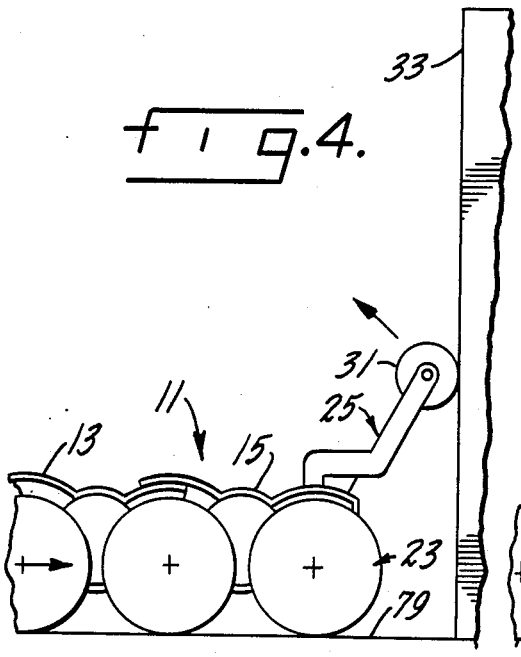
FIG. 4 is a partial schematic view showing the moving vehicle when it first engages an obstacle.
Figure 5:
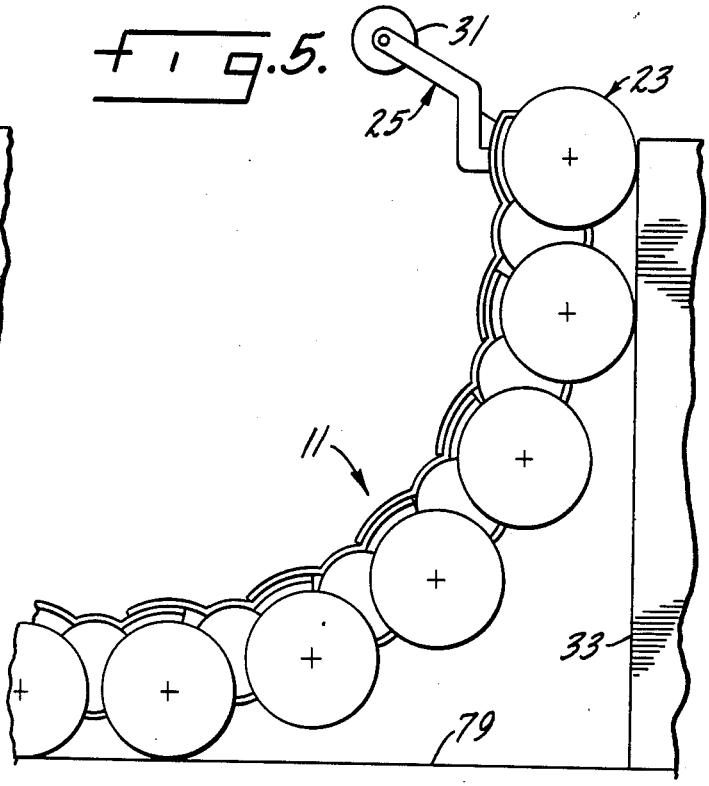
FIG. 5 is a view similar to FIG. 4 showing the vehicle pushing its way up the side of an obstacle.
Figure 6:
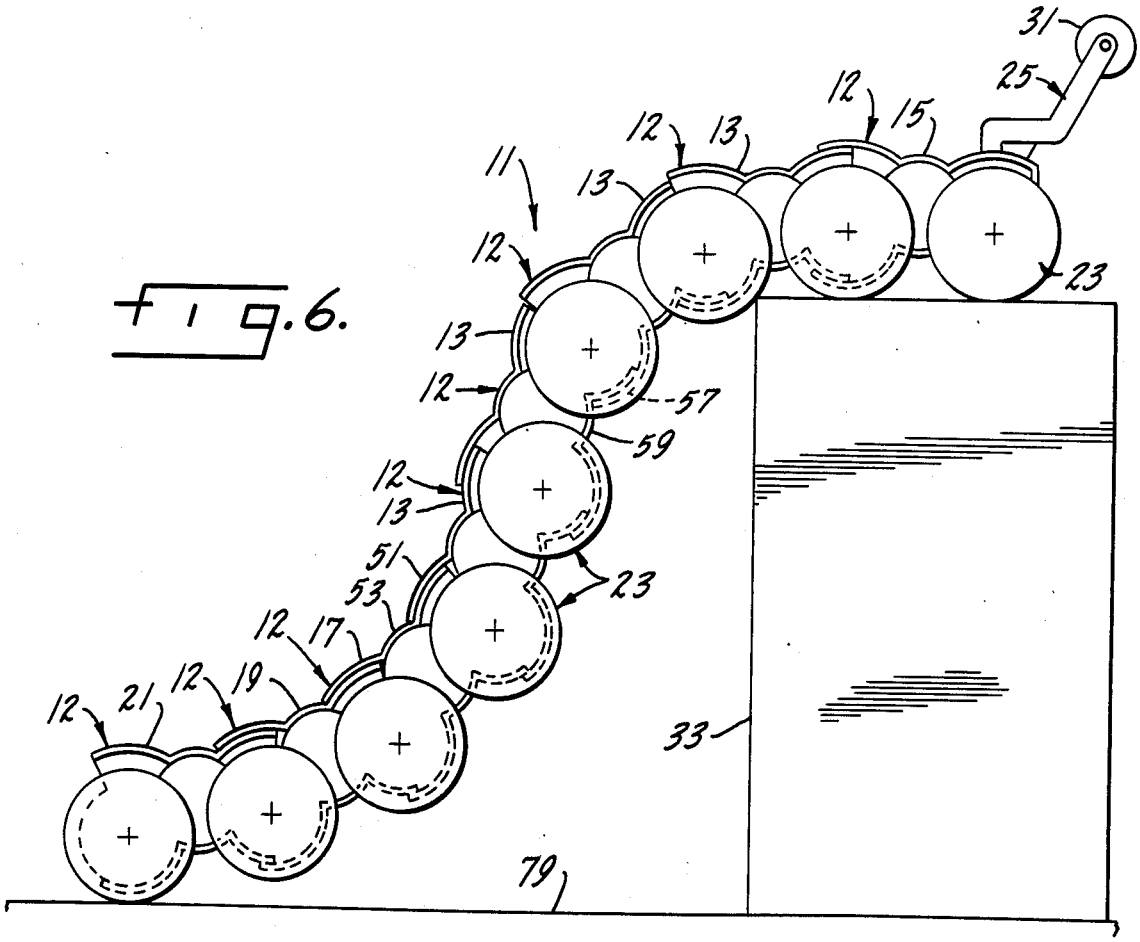
FIG. 6 is a view similar to views 4 and 5 showing the vehicle surmounting an obstacle.

FIG. 1 of the drawings is a top plan view of a vehicle 11 embodying the novel features of this invention. The vehicle consists of a number of individual units 12, in this case eight, connected together to form the vehicle. One feature of this invention is that the vehicle may be made in any desired length simply by connecting a selected number of units. The minimum length vehicle would consist of two units 12 while a maximum length vehicle would be determined by the height of the obstacle to be climbed. The individual units 12 making up the vehicle consist of idler units 13, a front unit 15, a battery supply unit 17, a main power unit 19, and a rear unit 21. A minimum length vehicle would have only a front unit 15 and a rear unit 21. Each unit 12 has axles 22 and each unit, except the front unit 15 and the unit 21 at the rear of the vehicle, share their two axles with adjacent units. Wheels 23 are mounted on the ends of each axle. A tilt assist sensor 25 having upward and forwardly extending arms 27 supporting a cross shaft 29 on which are mounted rollers 31 is mounted on the top of the front unit 15. As is most clearly shown in FIG. 4, the rollers 31 will first engage an obstacle 33 to assist the vehicle in climbing up and over the obstacle in the manner shown in FIGS. 5 and 6 of the drawings. The tilt assist sensor will also aid the front unit 15 of the vehicle in returning downwardly to the supporting surface.

Figure 2:
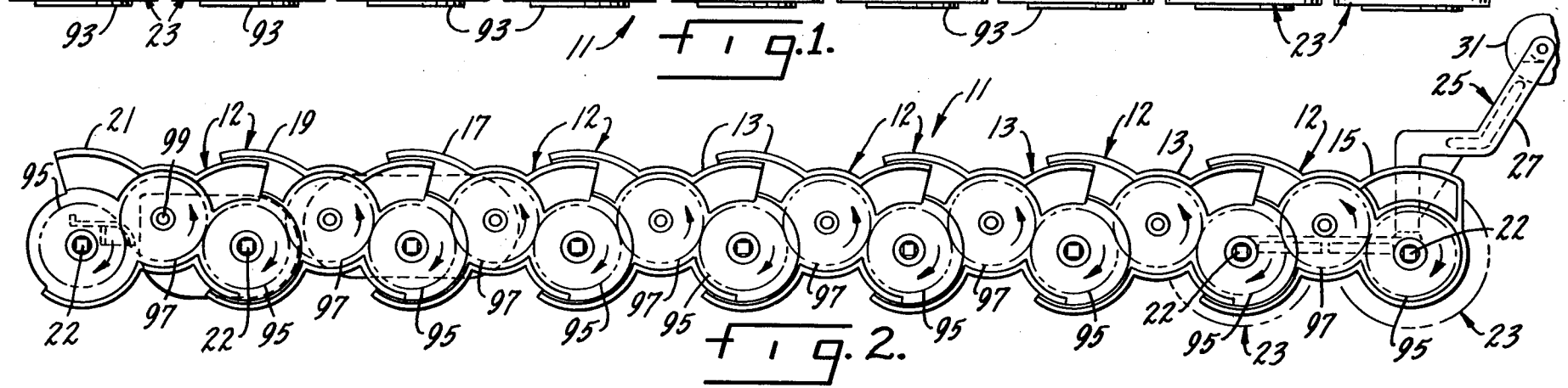
FIG. 2 is a side elevational view of the unit of FIG. 1 with the wheels removed for clarity of illustration.
Figure 3:
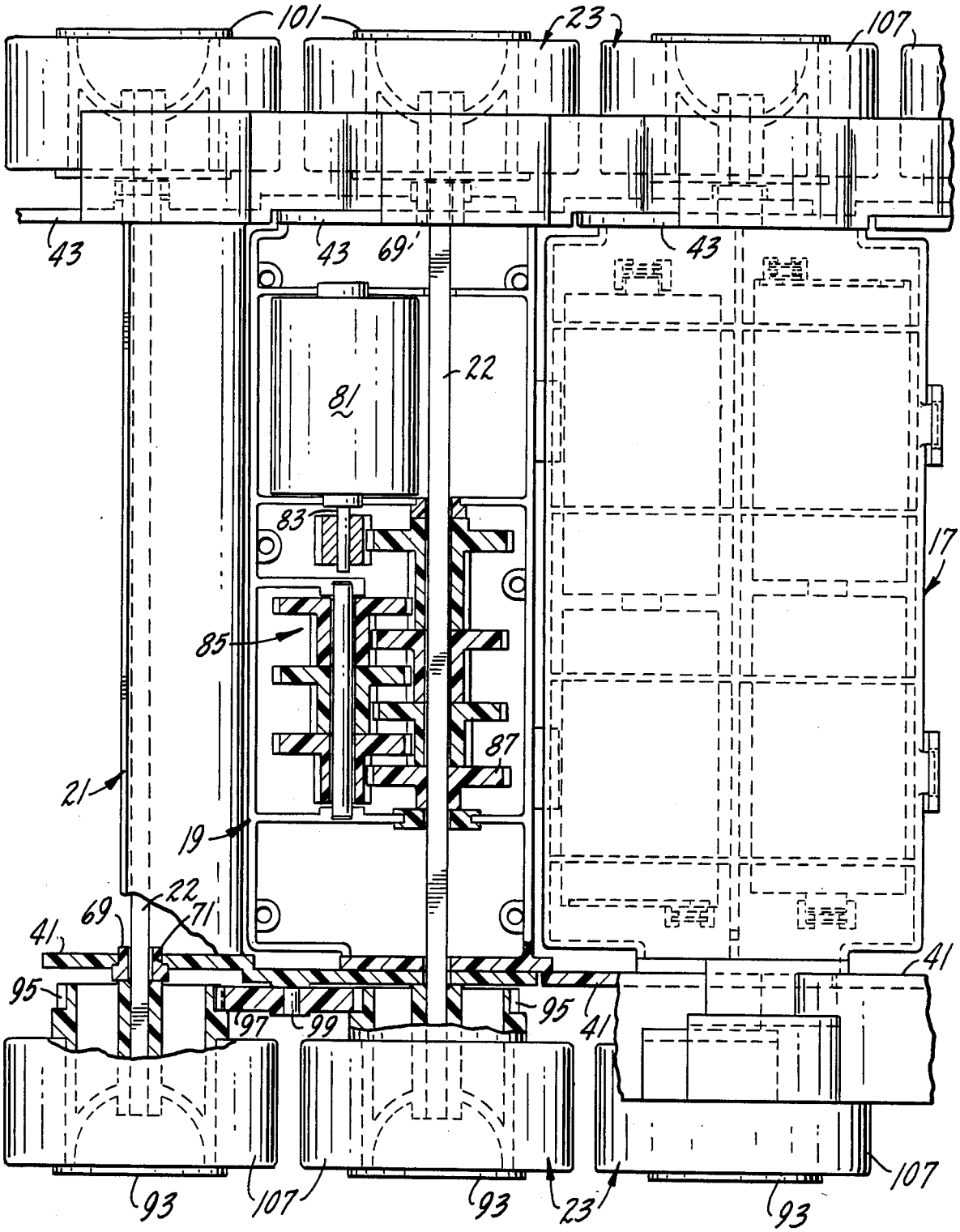
FIG. 3 is an enlarged top plan view of the rear portion of the vehicle with some parts removed, some broken away and others shown in broken lines for clarity of illustration.

A unit 13 whose general construction is typical of the units forming the vehicle 11 is shown in enlarged detail in FIGS. 7, 8 and 9 of the drawings. Each unit is integrally molded of a high impact plastic and has a top wall 37 reinforced on the underside by ribbing 39 and generally flat, side walls 41 and 43. On the right hand side of the vehicle, as viewed in FIG. 7 and shown in FIG. 8, arcuate top and bottom fenders 45 and 47 are provided. The top fender has a front arc 49, a rear arc 51 with the arcs joined by a connecting arc 53. The bottom fender 47 has a corresponding front arc 55, rear arc 57 and a connecting arc 59. The opening of the front fenders is smaller than that of the rear fenders so that the front fenders fit inside the rear fenders as shown most clearly in FIG. 2 of the drawings to intermesh the units 12 into a train 11. On the left side of the vehicle, as shown in FIG. 9, only a top fender 61 is provided. This fender also has a front arc 63, rear arc 65 and connecting arc 67 so as to interfit with similar fenders on adjacent units. As can be most clearly seen in FIG. 6, the ends of the rear arcs of the fenders engage the connecting arcs to limit rotation of the units relative to one another. The upward rotation of one unit 12 relative to an adjacent unit 12 is stopped when the end of a rear arc 51 of the top fender 45 of one unit engages the connecting arc 53 of the adjacent unit. The downward rotation of another unit 12 of the vehicle is stopped when the end of the rear arc 57 of its lower fender 47 contacts the connecting arc 59 of the adjacent unit. The amount of vertical rotation of adjacent units 12 relative to one another can be readily changed by varying the lengths of the rear arcs of the fenders. It should also be appreciated that the amount of rotation upwardly and downwardly need not be identical and the rotation in one direction can be adjusted independently of the rotation in the other direction.

Adjacent units 12 are held together in their intermeshing relationship by the axles 22 which pass through bearings 69 which fit in openings 71 formed in the overlapping side walls 41 or 43 of adjacent units. To restrain the front unit 15 and three following idler units 13 from immediately folding back on themselves when the vehicle encounters an obstacle 33, springs 73 encircle the bearings for the axles 22 common to these four units. The ends 75 of the springs are anchored to bosses 77 molded on the adjacent units. The springs 73 act to bias the wheels 23 of these units against the supporting surface whether it be horizontal as surface 79 or vertical as surface 33 shown in FIGS. 4–6 of the drawings as the vehicle climbs over the obstacle. Even if the springs are overpowered, the units will be limited in the amount they can fold back on one another by the engagement of their intermeshing fenders as previously described.

One of the advantages of the vehicle 11 of this invention is that only a single power unit is required to drive the entire vehicle no matter how long it is or how many wheeled units 12 it consists of. In this example, the main power unit 19 is positioned as the next to last unit in the vehicle, although it should be understood and appreciated that more than one power unit may be utilized and these power units may be located anywhere throughout the length of the vehicle. However, it is advantageous to have the power unit located near the rear unit of the vehicle since this helps push the vehicle over obstacles.

In this embodiment of the invention, the main power unit 19 is supplied by four "C" or "D" batteries housed in the battery supply unit 17 which is located next to the main power unit 19. The wiring connecting the batteries to the electric motor 81 is not shown for clarity of illustration because it is conventional. The electric motor 81 is a high speed, direct current motor and its output shaft 83 drives a speed reduction gear train 85. The output gear 87 of the gear train is mounted on an axle 22 for rotation therewith to drive the axle. The axle 22, which has a square cross-section, seats in a wheel hub 93 mounted on the end of the axle. A drive gear 95 is formed integrally with the wheel hub on the vehicle side of the hub. A tire is mounted on this hub to complete the wheel 23. The drive gear 95 meshes with idler gears 97, each mounted on a stub 99 formed on the outside of the side walls 41 of the units 13. The idler gears 97 mesh with gears 95 formed on the other wheel hubs 93 which are located on the right hand side of the vehicle. Each of these wheel hubs is mounted on the end of a square shaft 22 in the manner previously described. This arrangement of drive gears and idler gears provide a positive drive for all the wheels of the vehicle. On the left hand side of the vehicle, wheel hubs 101 are seated on the ends of the axles 22 to rotate therewith. Tires are mounted on these hubs to complete the wheels 23. The positive drive aspect of all the wheels on the vehicle enable it to climb over obstacles in the manner shown in FIGS. 4–6 since at least some of the driven wheels will be in contact with a supporting surface no matter what position the vehicle is in. Of course, the idler gears 97 could be replaced by a suitable belt or chain drive or drives.

Figure 10:
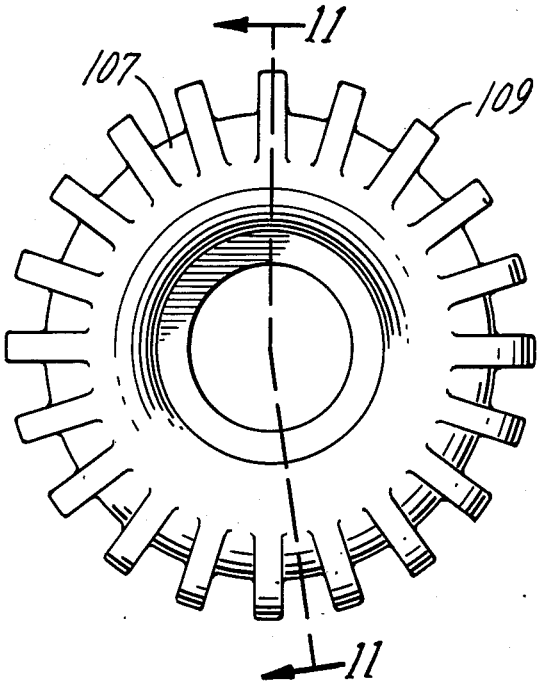
FIG. 10 is a side elevational view on an enlarged scale of a tire used on the vehicle.
Figure 11:
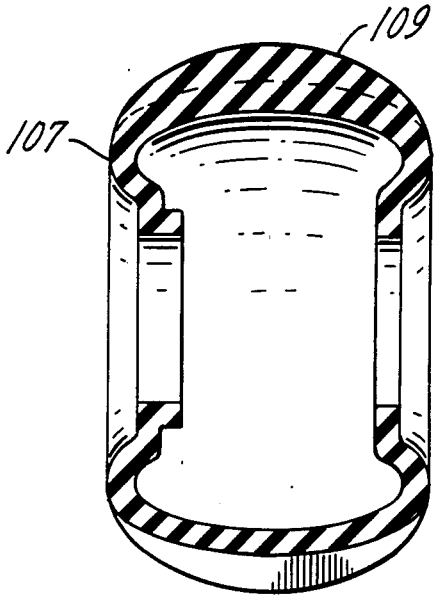
FIG. 11 is a cross sectional view taken along line 11—11 of FIG. 10.

Each wheel 23 includes a high friction tire 107 shown in enlarged detail in FIGS. 10 and 11 of the drawings. The tire includes radially extending, relatively thin teeth 109 which extend beyond the main body of the tire to provide gripping for corners and climbing over obstructions. The tires may be molded of a suitable synthetic rubber material which will provide sufficient resilience and flexibility. The tires can be snapped over the drums of the wheel hubs 95 and 105.

Whereas, the invention has been shown embodied in a toy vehicle, it should be understood and appreciated that many aspects of the invention can be applied to full-sized vehicles both commercial and military. Therefore, the scope of the invention should be limited only by the language of the claims appended hereto.

We claim:

1. An elongated vehicle adapted to be propelled along an engaging surface and capable of climbing over obstacles on said engaging surface, including:

a plurality of individual wheeled units, including front and rear units, each unit having supports for two laterally extending, longitudinally spaced axles which have wheels mounted on the ends of the axles, each unit, except for the front an rear units of the vehicle, having two axles, both of which are shared with adjacent units, the front and rear units each having two axles but sharing only one axle with an adjacent unit, each unit having a body mounted on its axles which body is rotatable relative to each of the axles, each body including side members which are held in spaced relationship to each other by a top member, said axle supports being formed in said side members, said side members of the bodies of adjacent units intermeshing and overlapping to permit the axle supports of adjacent units to be aligned to receive the shared axles, stop means formed on the bodies independently of the top members and positioend to engage one another to limit rotation of adjacent units relative to one another about their shared axles to prevent one unit from folding back over an adjacent unit, and means to drive at least some of said wheels to propel said vehicle along the engaging surface.

2. The unit of claim 1 in which the intermesh and overlap of the side members of the body are provided by fenders having front arcs and rear arcs with intermesh and the stop means include connecting arcs in the fenders which engage the rear arcs to limit movement of the body of one unit relative to the body of the other unit.

3. The vehicle of claim 1 in which means are provided to bias some of the wheels of the units into engagement with the engaging surface.

4. The vehicle of claim 1 in which a tilt assist sensor is mounted on the front unit of the vehicle and extends in front of and above the vehicle to engage an obstacle before the vehicle engages the obstacle and upon engaging the obstacle forces the units to rotate back upon the following units.

5. The vehicle of claim 1 in which the means to drive at least some of the wheels includes a drive motor and speed reduction gearing carried by one of the wheeled units, a drive gear on one side of the vehicle at the output of the speed reduction gearing, driven gears formed on the wheel hubs on said one side of the vehicle and idler gears connecting the drive gear and the driven gears.

6. The elongated vehicle of claim 1 in which the stop means are positioned on the bodies to limit rotation of adjacent units to not more than 90 degrees relative to each other.

* * * * *